United States Patent [19]

Paulini et al.

[11] Patent Number: 4,858,809

[45] Date of Patent: Aug. 22, 1989

[54] CONVEYING OF FILAMENT BUNDLES OVER LONG CONVEYING SECTIONS

[75] Inventors: Dieter Paulini, Dormagen; Peter Schmitz-Bastian, Erftstadt/Liblar; Wolfram Wagner; Günter Bieber, both of Dormagen, all of Fed. Rep. of Germany

[73] Assignee: Bayer Aktiengesellschaft, Fed. Rep. of Germany

[21] Appl. No.: 194,885

[22] Filed: May 17, 1988

Related U.S. Application Data

[62] Division of Ser. No. 10,461, Feb. 3, 1987, abandoned.

[30] Foreign Application Priority Data

Feb. 15, 1986 [DE] Fed. Rep. of Germany ..... 3604819

[51] Int. Cl.[4] ..... B65H 20/10

[52] U.S. Cl. ..... 226/97; 226/7

[58] Field of Search ..... 226/7, 97, 108, 112

[56] References Cited

U.S. PATENT DOCUMENTS

| | | | |
|---|---|---|---|
| 3,008,865 | 11/1961 | Hayes et al. | 226/97 |
| 3,559,860 | 2/1971 | East | 226/97 |
| 3,705,676 | 12/1972 | Overly et al. | 226/97 |
| 3,764,085 | 10/1973 | Hawkins | 226/97 X |
| 4,074,841 | 2/1978 | Kramer et al. | 226/97 |
| 4,366,845 | 1/1983 | Simson | 226/97 X |
| 4,470,529 | 9/1984 | Wetter | 226/97 |
| 4,593,521 | 6/1986 | Stalder et al. | 226/97 X |

*Primary Examiner*—David Werner
*Assistant Examiner*—Phillip Han
*Attorney, Agent, or Firm*—Connolly and Hutz

[57] ABSTRACT

For the purpose of conveying slivers the latter are fed over constructional units (15) which are situated behind each other in a staggered maner from injector (8), in a pipe (16) including a guide means (17) by means of an air supply, and subsequently carried further by mechanical means.

2 Claims, 3 Drawing Sheets

CONVEYING OF FILAMENT BUNDLES OVER LONG CONVEYING SECTIONS

CROSS-REFERENCE TO RELATED APPLICATION

The present application is a division of application Ser. No. 010,461 filed Feb. 3, 1987, now abandoned.

The invention concerns a process for the conveying of filament bundles, in particular, slivers over long conveying sections for the purpose of the direct connection of different operational stages in the production of fibres and a device for the carrying out of the process.

Up to now it has been usual to collect filaments and/or slivers after the spinning process in cans which are then transported to the next installation which is usually at a distance in spatial terms, where the filament is again drawn out of the can for further processing—such as washing, stretching, crimping etc.

The disadvantage of handling of this nature consists essentially in the fact that the sensitive intermediate products can be damaged while they are being packed and unpacked from the can, localised coordination of the filaments in relation to each other is disturbed, increased expenditure on conveying is necessitated by a continuous conveying operation and additional storage costs are incurred.

It is the object of the invention to find a way of conveying the moist or dry filaments resulting from the spinning process and slivers which are not bound together by loosely conveyed as a bundle in a relatively ordered parallel state directly to the next operational stage, which possibility admits of the conveying of these filaments and slivers carefully over a relatively long section without any change in the properties and mutual coordination, in which process the possibility of rethreading securely and quickly on account of the high operational speeds usually obtained must exist in the case of starting up and, respectively, in cases of operational failure.

The object is achieved according to the invention by pick up the end of a filament bundle at particular intervals by staggered means of injectors arranged behind each other along the conveying section, for the purpose of positioning, in order that in each case it could then be conveyed, suspended freely, in a flow stream produced by the injector within a closed channel, past guide means arranged there obliquely until part of the flow stream is moved to one side whilst the next injector takes over the function at the same time for the purpose of conveying further, and by the switching off of the injectors after the positioning operation, in which process the filament is then supported over the guide means during conveying.

By means of repeated centering at particular intervals during suspended conveying when the filament ends are being fed, entangling or catching on the guide means is avoided, even over long conveying sections, which guide means are, in their turn, necessary in order to avoid wear and tear during normal operations by means of mechanical doffing caused by a small degree of positioning and stretching caused by a small degree of friction in this very sensitive intermediate product. With the process a secure and rapid feed is possible with small quantities of air, even with a small pipe cross section, which is often necessary for spatial reasons, since each injector can be run virtually along the length at the optimal working point on account of the small drop in the pressure, with a result that no clogging occurs. The ratio between the conveying air speed and the sliver speed ($V_{T+S}/V_B$) should be in the region of between 4 and 16, preferably between 8 and 10.

Known manual feeding nozzles are used for the transfer of the sliver, which nozzles draw in the approaching sliver. The free end is cut off. The sliver which runs into the feeding nozzle is taken past the injector by means of an auxiliary device and separated through between the two, with the result that the injector sucks it in the shape of a loop, which is broken down in the conveying section. In order to guarantee the secure transfer of the sliver from the feeding nozzle to a conveying injector the conveying injector must suck in a particular quantity of air and thus must take the sliver in with it. The ratio between the speed of air which is sucked in at the suction mouth and the speed the sliver ($V_S/V_B$) should be in the region of between 2 and 25, preferably between 15 and 20.

A device in which two or more constructional units which are situated behind each other as the conveying section are arranged with a short distance between each of them is used for the carrying out of the process, which units consists, in each case, of an injector with a connecting closed channel, including fitted guide means.

In conveying over great distances it is advantageous to arrange standardised constructional units behind each other which, in each case, consist of only a few elements, namely of an injector, a pipe and individual guide means. The length of the channels depends on the capacity of the conveying injector, the loss of pressure of the conveying air stream through friction, the required suction air speed and the necessary conveying air speed (suction air and driving air). The free outlet surface which is present because of the interval between the constructional units should be between twice and six times the cross section area of the pipe.

By means of flat cross-sections which can have a rectangular or oval shape it is possible to carry slivers even up to a width of between 300 and 400 mm in a channel in such a way that virtually the same conveying conditions prevail for all filaments running parallel, and in such a way that the consumption of conveying air is small.

Guiding means which project into the pipe from the side of the pipe have proved to be advantageous, the air flow surface of which means is inclined at an angle of between 10° and 60° to the pipe axis in the conveying direction, and which means have a narrow saddle at the top which rises gradually to the sides of the channel, whereby the sliver always centres itself automatically during the run.

Finally, turning of the filament bundle can take place by means of a wheel rotating at the same speed which wheel corresponds in its circumference contour to that of the guiding means, and forms a part of a quarter bend which is necessary for pneumatic turning, in which either the wheel or the half pipe bend can be hinged for monitoring. By means of the wheel which rotating at the same speed during mechanical doffing of the filament bundle, wear and tear at the bend is largely avoided.

BRIEF DESCRIPTION OF THE DRAWING

An example of the invention is represented in the drawings and is described in greater detail in what follows. The following are shown.

DETAILED DESCRIPTION OF THE INVENTION

Figure 1:
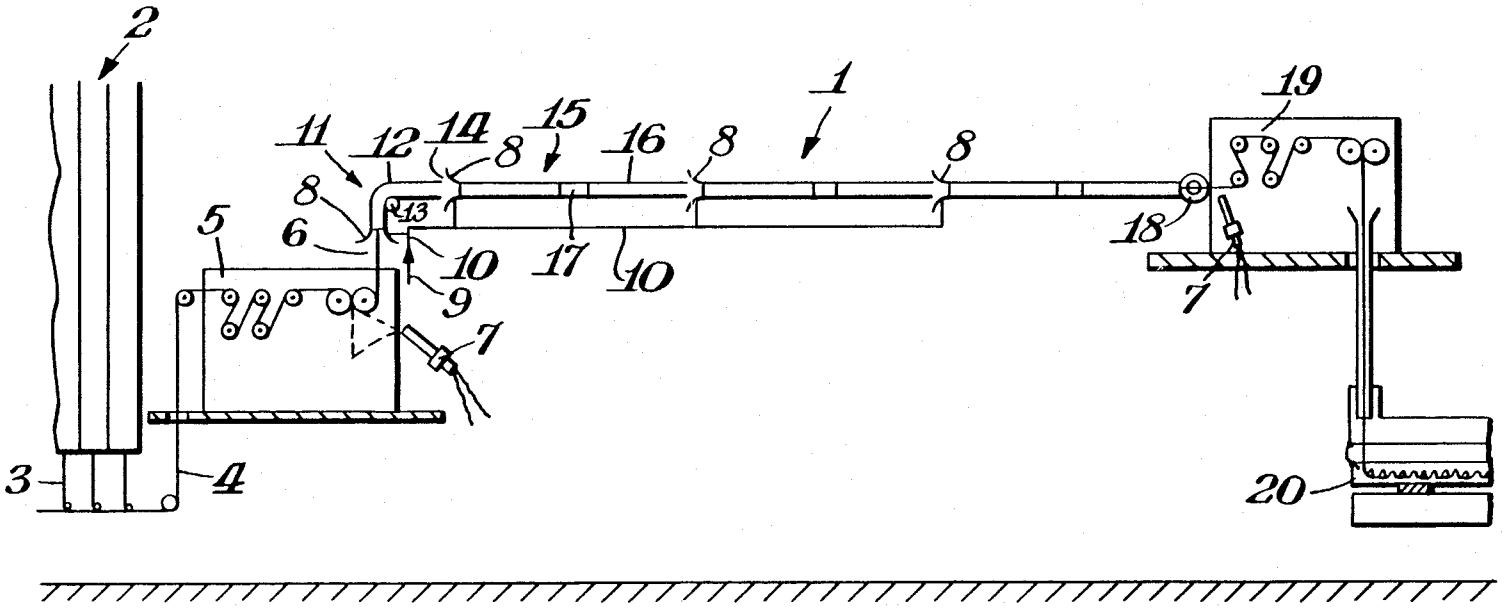
FIG. 1 a diagram of a conveying section

In FIG. 1 the threading of a filament bundle 2 over a long conveying section 1 is represented.

Small filament bundles 3 in the shape of a sliver 4 are drawn off from the spinning machine via a drawing off device 5. For the purpose of threading the end of the sliver is introduced into the first injector 8 in section 6 with a feeding nozzle 7, to which injector air 9 is brought via pipe 10. Turning takes place in pipe quarter bend 11 which is formed from a bend part 12 which can be hinged and a roller 13. At the end of the pipe a ring-shaped slit 14 for the discharging of driving air 9 is present as a gap before the next injector. The following constructional units 15 consist of an injector 8 with a pipe 16 and, possibly, a guiding means 17. At the end what is termed a "loss injector" 18 is situated which sucks the end of the sliver in, from whence it is placed onto the feed device 19 for the subsequent processing installation 20 with a feeding nozzle 7. After that the air feed is switched off and sliver 4 is conveyed mechanically.

For feeding the slivers into the conveyor path all injectors 8 are supplied with air. they suck and convey the slivers by the introduced air. The structure of all injectors 8 are also of the loss injector 18 are the same. But loss injector 18 is arranged transverse to the conveyor path. By this way a smooth continued running of the slivers is realized. After the slivers have reached the station behind the conveyor path and are picked up therein, the air supply is interrupted and conveyed of the slivers is not fulfilled only by mechanical pulling. The injectors are switched off by interrupting the air supply.

Figure 3:
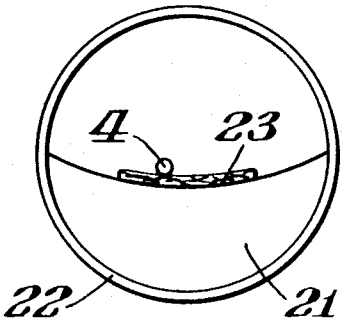
FIG. 3 a cross-sectional through a channel with guiding means.
Figure 2:
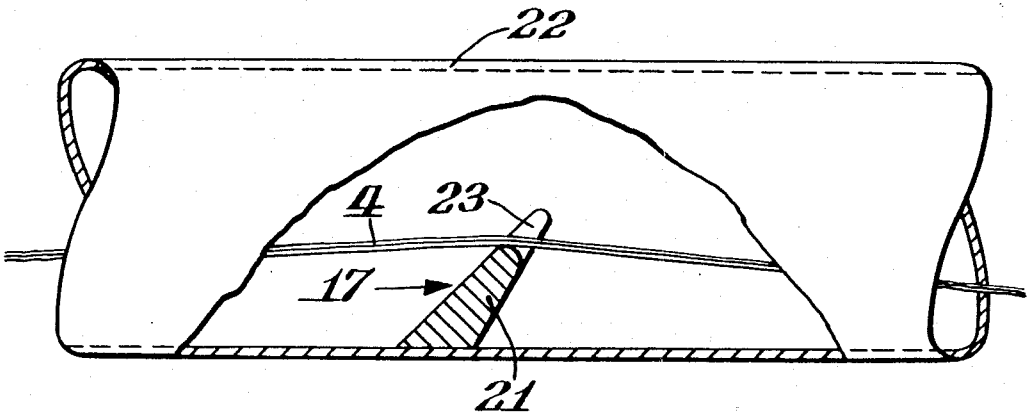
FIG. 2 a longitudinal section through a channel with the guiding means

In FIGS. 2 and 3 a longitudinal section and a cross section through pipe 16 is shown at the point where a guide means 17 is fitted in for a sliver 4, which consists of a body 21 which is inclined in the conveying direction, which body has a seat in the shape of a saddle which rises to pipe sides 22, over which sliver 4 is passed during the mechanical conveying.

Figure 4:
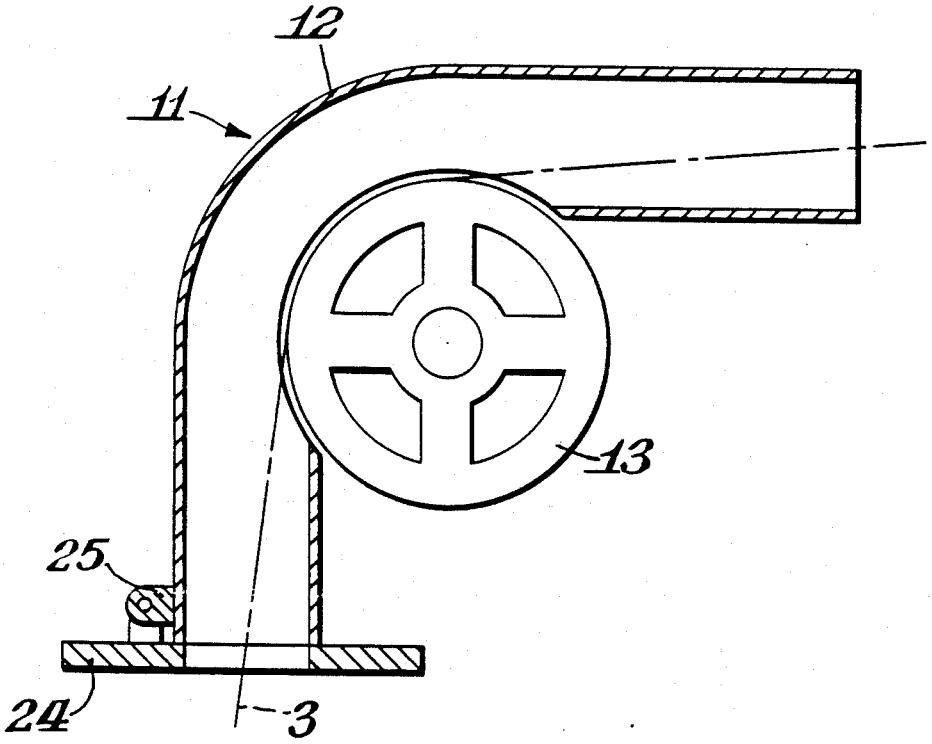
FIG. 4 a longitudinal section through a bend.

In FIG. 4 turning of sliver 4 is shown. On a flange 24 a bend part 12 which can be hinged is secured on a joint 25, which bend part joins onto roller 13 whilst a small gap remains, and forms a pipe quarter bend 11 with this, while sliver 4 is guided in with the air flow. In the subsequent mechanical conveying, sliver 4 rests against roller 13 which also turns.

EXAMPLE 1

In an installation a sliver with a sliver weight of up to 40 g/m and approximately 70% moisture, and a sliver width of up to 30 mm will be conveyed over a distance of up to 30 m. A glass pipe DN 80 is mounted as a channel here. The annular gap injectors which are connected previously have a clear suction mouth diameter of 50 mm. For the purpose of supporting the sliver in the pipe the 4 m conveying pipes were combined out of two pipe pieces and a guide plate mounted at the flange point. Fitted turning rollers ensure that the sliver turns twice in the vertical and in the horizontal plane.

EXAMPLE 2

In a second installation, however, a sliver of a width of up to 150 g/m with approximately 10% moisture must be conveyed over a distance of approximately 12 m. For this purpose an oval pipe of a width of approximately 300 mm and height of approximately 80 mm was used. The injectors are adapted to this shape and have a large number of fine bore holes instead of the annular gap on the perimeter of the oval ring channel for the driving air feed. Additional fitted parts were not required here since the sliver has a favourable coefficient of friction on account of its low level of moisture.

We claim:

1. A process for conveying continuous fiber filaments from a first operational stage to a distant operational stage comprising the steps of initially introducing the fiber filaments into a first air injector at the front of a conveyor channel, pneumatically moving the fiber filaments through the first air injector and the conveyor channel by creating and maintaining an air flow stream through the channel, allowing the air flow stream to escape at spaced apart locations along the conveyor channel while injecting air into the channel at those locations in order to continue pneumatic movement of the filaments through the channel, mechanically guiding the fiber filaments within the conveyor channel, continuing to pneumatically convey and mechanically guide the fiber filaments through the conveyor channel until the filaments reach the distant operational stage, terminating the air flow stream when the filaments reach the distant operational stage, and pulling the filaments from the first operation stage to the distant operational stage through the coneyor channel, while continuing to mechanically guide the fiber filaments within the conveyor channel.

2. A process as in claim 1 including the step of guiding the fiber filaments at the end of the conveyor channel into the distant operational stage by directing an air stream onto the fiber filaments.

* * * * *